US009024712B2

(12) United States Patent
Zusman

(10) Patent No.: US 9,024,712 B2
(45) Date of Patent: May 5, 2015

(54) MECHANICAL VIBRATION SWITCH

(71) Applicant: PCB Piezotronics, Inc., Depew, NY (US)

(72) Inventor: George V. Zusman, Houston, TX (US)

(73) Assignee: PCB Piezotronics, Inc., Depew, NY (US)

( * ) Notice: Subject to any disclaimer, the term of this patent is extended or adjusted under 35 U.S.C. 154(b) by 0 days.

(21) Appl. No.: 14/072,224

(22) Filed: Nov. 5, 2013

(65) Prior Publication Data

US 2014/0216909 A1 Aug. 7, 2014

Related U.S. Application Data

(60) Provisional application No. 61/759,581, filed on Feb. 1, 2013.

(51) Int. Cl.
*H01H 9/00* (2006.01)
*H01H 35/14* (2006.01)

(52) U.S. Cl.
CPC ..... *H01H 35/144* (2013.01); *H01H 35/142* (2013.01)

(58) Field of Classification Search
CPC ..... H01H 35/144; H01H 35/142
USPC ..... 335/90, 235, 248, 271, 277, 205; 200/52 R
See application file for complete search history.

(56) References Cited

U.S. PATENT DOCUMENTS 3,081,622 A * 3/1963 Kalb et al. ..... 73/658
5,034,729 A * 7/1991 Lundquist ..... 340/683

* cited by examiner

*Primary Examiner* — Bernard Rojas
(74) *Attorney, Agent, or Firm* — Phillips Lytle LLP; David L. Principe

(57) ABSTRACT

A mechanical vibration switch having a magnet connected to a bar that rotates about an axis, an inertial mass connected to the bar, a magnetic material part disposed in a predetermined spaced apart relation from the magnet, a spring, a stop, and an electrical relay mechanically actuated by the bar. The magnetic material part is adjusted parallel to the magnet such that the magnetic force varies approximately linearly with the common surface area S between the face of the magnet and the face of the magnetic material part.

20 Claims, 3 Drawing Sheets

MECHANICAL VIBRATION SWITCH

CROSS-REFERENCE TO RELATED APPLICATION

The present invention claims priority benefit of U.S. Provisional Patent Application No. 61/759,581 entitled "Mechanical Vibration Switch" filed on Feb. 1, 2013, which is incorporated herein by reference.

TECHNICAL FIELD

The present invention relates generally to vibration controls and, more specifically, to an improved vibration switch for rotary or reciprocating machinery protection. More specifically, the invention relates to a mechanical vibration switch.

BACKGROUND ART

A mechanical vibration switch is a device that senses mechanical vibrations on various types of machinery and changes state when a threshold vibration level is reached. The purpose of the switch is to either provide an alert that the machine is vibrating unacceptably or to shut the machine down so that damage does not occur. Referring to FIG. 1, a prior art mechanical vibration switch 10 typically includes a small rare earth magnet 13, a magnetic material part 16 (usually a steel plate), an inertial mass 19, a spring 22, and an electrical relay 25. The magnetic material part 16 is mounted to the main switch mechanism 28, and its position relative to the magnet 13, in the set position, is adjustable by means of a screw or the like (not shown). The magnet 13 is mounted on a bar/lever 31 that is acted on by the spring 22, and the lever arm 31 is also mechanically connected to the throw of the electrical relay 25. The bar 31 may rotate about a pivot point 32 in the direction of arrow 33. In the set position, the electrical relays 25 are in one state, either NO (normally open) or NC (normally closed), and the relays 25 change state depending on the position of the bar 31. The bar 31 is also resting against a mechanical stop 34 in the set position. The mechanical stop 34 is also part of a sprung inertial mass mechanism. When the mechanical switch is in the set mode, the position of the magnetic material part 16 is adjusted so its distance d (gap) from the magnet 13 is such that the mechanical vibration switch 10 remains in the set position, but the magnetic part 16 is spaced a sufficient distance away from the magnet 13 so that the switch will change states when a threshold vibration level is encountered.

The sprung mass 19 (M) exerts an inertial force (F) on the bar 31. If the inertial force (F) plus the spring force $F_{spring}$ become greater than the magnetic force $F_{magnet}$ holding the switch in the set position, then the switch will change states. Thus, as vibration increases, the inertial force (F) increases until sufficient vibration is encountered to trip the switch. When the switch trips, the bar 31 moves the electrical relay 25 (relay throw) to the opposite position which changes the state of the contacts (relay) thus warning of the machine problem or shutting the machine down.

The common surface area S of the surface on the magnetic material part 16 facing the magnet 13 remains constant and the distance d is adjusted in the direction of arrows 39 to adjust the sensititivity of the switch 10. The major problem with prior art mechanical vibration switch designs is that the adjustment of the force required to change the state of the switch is highly nonlinear with the distance d between the magnet 13 and the magnetic material part 16. This non-linear relation is illustrated by FIGS. 2 and 3. FIG. 2 shows a plot of distance d versus $F_{magnet}$. This graph shows that the force of the magnet drops in a non-linear manner as the distance d increases. Because of this non-linear relationship, the sensitivity of traditional mechanical switches is frequently set too low to be effective in protecting rotating machinery, and particularly when the machines operate at slow speeds (i.e., <6000 RPM).

BRIEF SUMMARY OF THE INVENTION

With parenthetical reference to corresponding parts, portions or surfaces of the disclosed embodiment, merely for the purposes of illustration and not by way of limitation, the present invention provides an improved mechanical vibration switch (100). In one aspect, a mechanical vibration switch (100) includes a magnet (103) connected to a bar (121) that rotates about an axis (124), an inertial mass (109) connected to the bar (121), a magnetic material part (106) disposed in a predetermined spaced apart relation from the magnet (103), a spring (112) acting on the bar (121), a stop (130) capable of contacting the bar (121), and an electrical relay (115) mechanically actuated by the bar (121). In another aspect, the magnetic material part (106) has a cylindrical shape, and the mechanical vibration switch is designed to provide sensitivity adjustment by moving the magnetic material part (106) parallel to the magnet (103) so that a constant gap is maintained but the common surface area is adjusted. In another embodiment, the mechanical vibration switch includes a magnet (203) having an inside face defined by a spherical or curved surface (204).

DETAILED DESCRIPTION OF THE EMBODIMENTS

Figure 1:
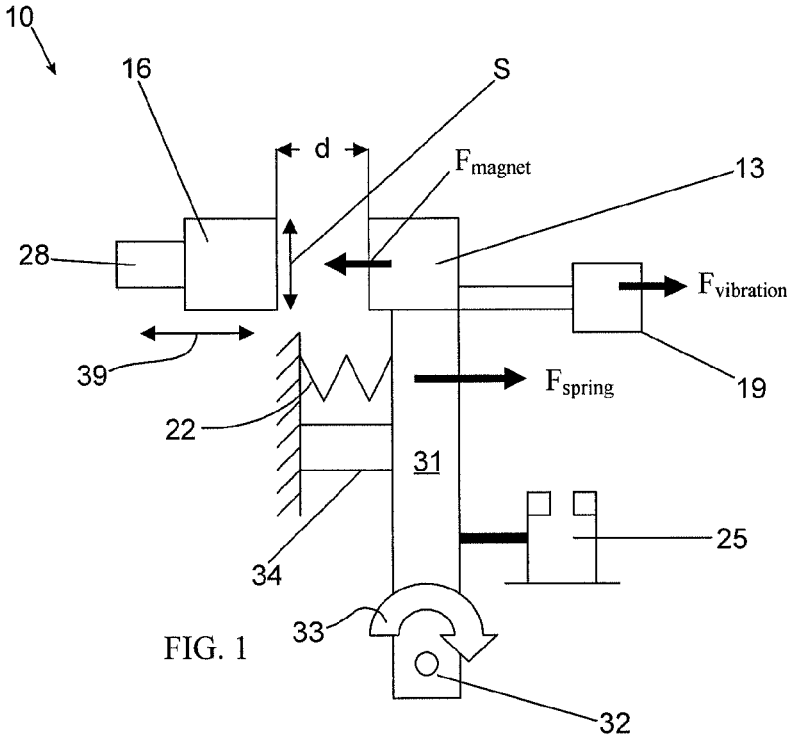
FIG. 1 PRIOR ART
FIG. 1 is a schematic diagram of a prior art mechanical vibration switch.

At the outset, it should be clearly understood that like reference numerals are intended to identify the same parts, elements or portions consistently throughout the several drawing figures, as such parts, elements or portions may be further described or explained by the entire written specification, of which this detailed description is an integral part. The following description of embodiments is exemplary in nature and is not intended to restrict the scope of the present invention, the manner in which the various aspects of the invention may be implemented, or the applications or uses thereof.

Unless otherwise indicated, the drawings are to be read (e.g., cross-hatching, arrangement of parts, proportion, degree, etc.) together with the specification, and are to be considered a portion of the entire written description of this invention. As used in the following descriptions, the terms "horizontal", "vertical", "left", "right", "up", "down", "parallel" and "perpendicular" as well as adjectival and adverbial derivatives thereof (e.g., "horizontally", "rightward", "upwardly", etc.) simply refer to the orientation of the illustrated structure as the partial drawing figure faces the reader. Similarly, the terms "inwardly" and "outwardly" generally refer to the orientation of surface relative to its axis of elongation, or axis of rotation, as appropriate.

Figure 4:
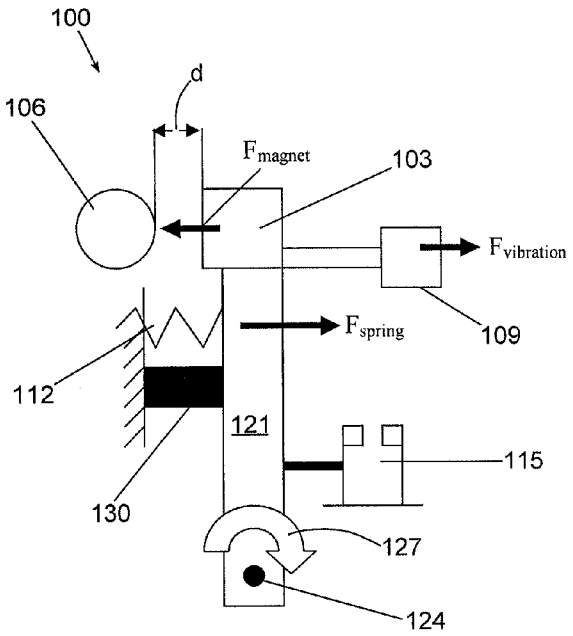
FIG. 4 is a schematic diagram of the mechanical vibration switch of the present invention.

With reference to the corresponding parts, portions or surfaces of the disclosed embodiment, merely for purposes of illustration and not by way of limitation, the mechanical vibration switch 100 of the present invention, as shown in FIG. 4 and described herein, has an improved switching mechanism that provides linearity of the force adjustment between the magnet 103 and the magnetic material part 106 (steel plate) making it possible to more accurately adjust the switch sensitivity. The mechanical vibration switch 100 consists of a small rare earth magnet 103, a magnetic material part 106 usually a steel plate, an inertial mass 109, a spring 112, and an electrical relay 115. The magnetic material part 106 (steel plate) is mounted to the main switch mechanism, and the position of the magnetic material part 106 relative to the magnet 103, in the set position, is adjustable by means of a screw 107 or the like. The magnet 103 is mounted on a bar/lever arm 121 that is acted on by the spring 112, and the bar 121 is also mechanically connected to the electrical relay 115. The spring 112 shown is a coil spring however other biasing members capable of providing a force on the bar 121 may also be substituted as will be evident to those of ordinary skill in the art based on this disclosure. The lever arm 121 may rotate about a pivot point 124 in the direction of arrow 127. In the set position, the electrical relays 115 are in one state, either NO (normally open) or NC (normally closed), and the relays change state when the switch trips. In addition to the electrical relay, other types of switches capable of changing state from NO to NC may also be used as will be evident to those or ordinary skill in the art based on this disclosure. The bar 121 is also resting against a mechanical stop 130 in the set position. The mechanical stop 130 may be part of a sprung inertial mass mechanism. When the mechanical switch is in the set mode, the position of the magnetic material part 106 relative to the magnet 103 may be adjusted to vary the common surface area S with magnet 103, but the distance d (gap) remains constant.

The sprung mass 109 (M) exerts an inertial force ($F_{vibration}$) on the bar 121 as given by Newton's $2^{nd}$ Law of Motion, $F_{vibration}=M\times A$, where A is the acceleration of the switch. When the inertial force ($F_{vibration}$) plus the spring force ($F_{spring}$) becomes greater than the magnetic force ($F_{magnet}$) holding the switch in the set position, the switch changes state. Thus, as vibration increases, the inertial force ($F_{vibration}$) increases until sufficient vibration is encountered to change the state of the switch. The change occurs when the bar 121 moves the electrical relay 115 (relay throw) to the opposite position thereby changing the state of the relay 115 and warning of the machine problem or shutting the machine down.

Figure 5:
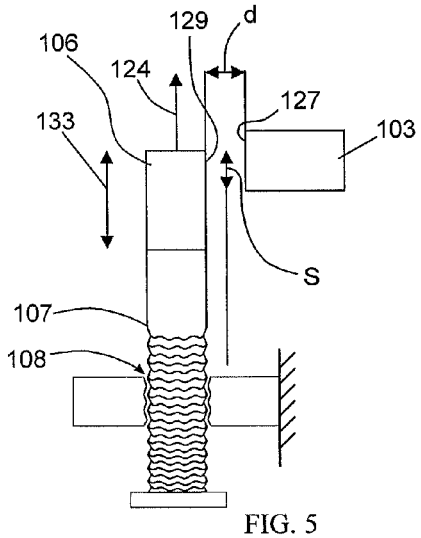
FIG. 5 is a schematic diagram showing how the adjustment of the sensitivity of the improved mechanical vibration switch works by keeping the gap constant and adjusting the common surface area of the magnetic material part and the magnet.
Figure 6:
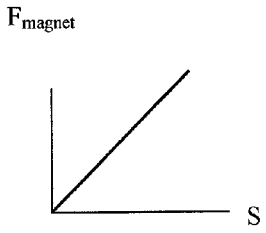
FIG. 6 is a plot showing the linear behavior of the magnetic forces vs. common surface area (S) between the magnetic part and magnet for the improved mechanical vibration switch of the present invention.
Figure 7:
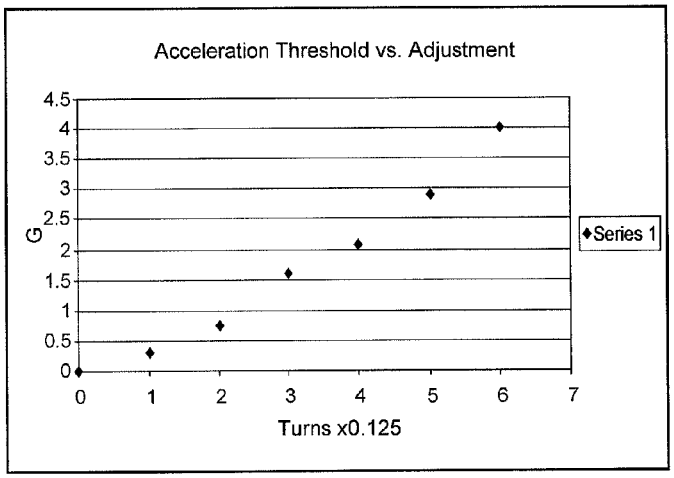
FIG. 7 shows experimental data for the mechanical vibration switch of the present invention demonstrating the linear relation between the acceleration threshold and the movement of the magnetic material part by turning a threaded adjustment; and, FIG. 8 is a detailed perspective view of the major components of an alternate embodiment of the vibration switch according to the present invention.

In the improved mechanical switch, for example, the magnetic material part 106 may be made in a cylindrical shape and the magnet 103 may be square. The cylindrical shape of the magnetic material part 106 provides for simple adjustment, for example, by means of rotation of a threaded portion 107 of the cylinder within a bore 108 having matching threads. Other shapes for the magnetic material part 106 having an outer surface suitable for interacting with the magnet 103 may also be used, but may require different mechanisms for advancing the magnetic material part 106 relative to the outer surface of the magnet 103. As shown in FIG. 5, the cylindrical shape of the magnetic material part 106 may be oriented such that a longitudinal axis 124 going through the center of part 106 is parallel to the surface 127 of the magnet 103 and along its centerline, as illustrated by FIG. 5. Part 106 is also oriented such that if an imaginary plane on the end of the magnetic material part 106 closest to the magnet 103 is extended, it will intersect the magnet 103 near the edge closest to the part 106. The movement directions of the mechanical switch sensitivity adjustment are shown by the arrows 133 in FIG. 5 and these adjustments can be realized in many ways, as will be evident to persons of ordinary skill in the art based on this disclosure. One example for adjusting the position of the magnetic material part 106 is by adjusting the screw 107 attached or formed integrally with the magnetic material part 106. When the adjusting screw 107 is turned, the plane 129 of the magnetic material part 106 (cylinder) moves across the magnet 103, and the distance d (gap) between the surface of the magnetic material part (cylinder) and the surface 127 of the magnet 103 remains constant. This movement of the magnetic material part 106 parallel to the magnet 103 results in a linear adjustment of the magnetic force $F_{magnet}$ vs. common surface area S of the magnetic material part 106 and magnet 103, which is illustrated by FIGS. 6 and 7.

The basic equation of the force between the magnet 103 and the magnetic material 106 can be simplified to the following.

$$F_{magnet} = B\left(\frac{S}{d^k + d_0}\right)$$

Figure 2:
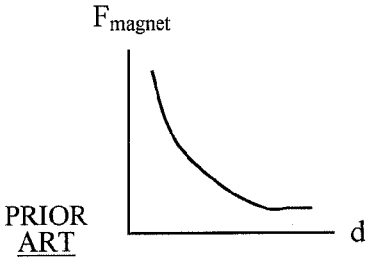
PRIOR ART FIG. 2
FIG. 2 is a plot showing the non-linear behavior of the magnetic forces vs. the distance d (gap) between the magnetic part and the magnet in a prior art vibration switch.
Figure 3:
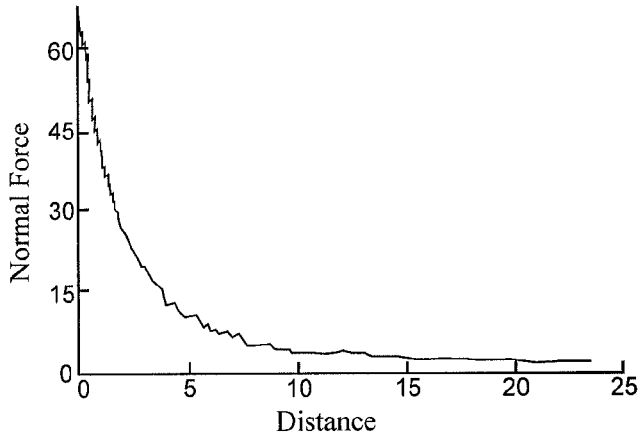
PRIOR ART FIG. 3
FIG. 3 is a plot showing experimental data for the magnetic forces vs. distance d (gap) between the magnetic part and the magnet in a prior art mechanical vibration switch.

$F_{magnet}$=magnetic force
B=flux density coefficient
S=common surface area
d=distance between magnet and plate (gap)
k=coefficient, usually lay in range of 1 to 2
$d_0$=coefficient defining the magnet force with zero gap It can be seen from the equation above, that adjusting the distance (gap) d between the magnet 103 and the magnetic material part 106 is a nonlinear function, as shown on FIG. 2 and confirmed by FIG. 3. Instead of adjusting the gap d, the present invention provides for adjusting the amount of common surface area S between the magnet 103 and magnetic material part 106 which has a linear relationship with the force of the magnet 103, as illustrated by FIG. 6 and is confirmed by FIG. 7.

Figure 8:
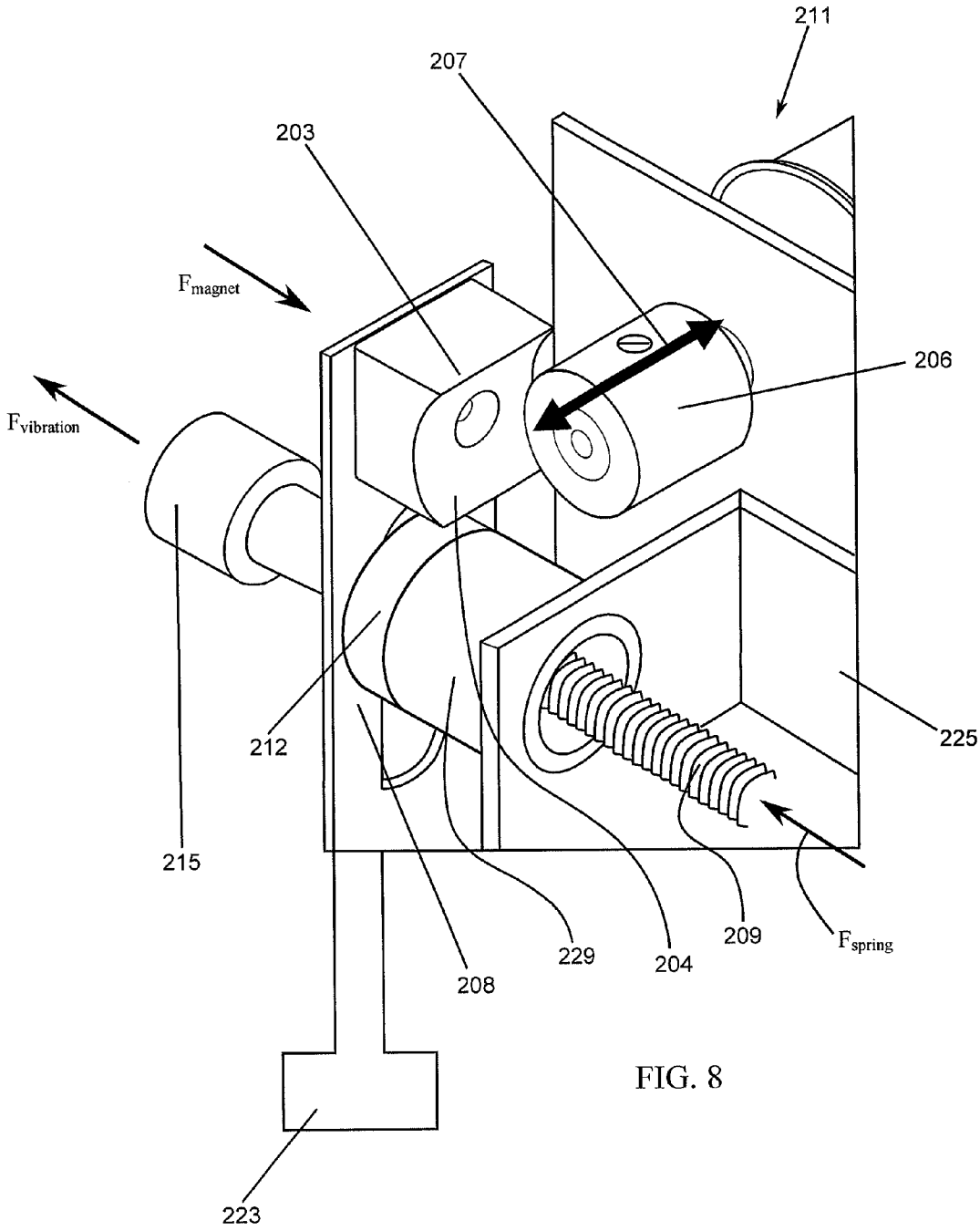

Turning to FIG. 8, an alternate embodiment of the present invention is shown. A magnet 203 having a curved face 204 is mounted on a bar 208. Although the face 204 is curved in the embodiment shown, the face 204 may also be shaped in the form of a flat planar surface. An inertial mass 215 is mechanically connected to the bar 208. A magnetic material part 206 is mounted on an adjustable mechanism 211 that carries the magnetic material part in the direction of arrows 207 to increase or decrease the common surface area S between the magnetic material part 206 and the magnet 203. As the common surface area S is increased by moving the magnetic material part 206 so that it moves over more of the face 204 of magnet 203, the force of the magnet $F_{magnet}$ increases. The inertial mass exerts a force $F_{vibration}$ in the direction shown in the figure. A spring 209 is configured such that it exerts a force $F_{spring}$ in the direction shown in the figure. When the inertial force $F_{vibration}$ and the spring force $F_{spring}$ becomes greater than the magnetic force holding the bar 208 in the set position, the bar 208 rotates and the state of an electrical relay 223 is changed by the movement of the bar 208 causing the contacts in the electrical relay 223 to be opened or closed. A bracket 225 supports an annular collar 229 that may be fixedly attached to the bracket 225. The spring 209 provides a force $F_{spring}$ to the bar 208 through the stop 212 which moves relative to collar 229 by means of the spring force. The spring 209 biases the bar 208 in a direction opposite the force of the magnet 203.

Accordingly, the adjustment of the magnetic material part 206 relative to the magnet 203, such that the distance d between the magnetic material part 206 and the magnet 203 remains substantially constant while the common surface area S increases or decreases, provides for linear adjustment of the sensitivity of the switch.

The present invention contemplates that many changes and modifications may be made. Therefore, while an embodiment of the mechanical vibration switch has been shown and described, and a number of alternatives discussed, persons skilled in this art will readily appreciate that various additional changes and modifications may be made without departing from the spirit of the invention as defined and differentiated by the following claims.

What is claimed is:

1. A mechanical vibration switch, comprising:

a bar pivotally attached to a reference structure;

a magnet disposed on the bar, the magnet having a first surface with a first surface area;

an inertial mass attached to the bar;

a magnetic material part disposed in spaced apart relation to the magnet such that a magnetic force acts on the bar in a first direction, the magnetic material part having a second surface, the second surface having a second surface area, the second surface facing the first surface of the magnet when the bar contacts a stop;

an electrical switch coupled to the bar such that the state of the switch changes from open to closed depending on the position of the bar;

a spring acting on the bar to provide a force in a second direction opposite to the first direction;

wherein the magnetic material part is adjustable between a first position where a first portion of the surface area S of the second surface is disposed in facing relation with a corresponding surface area S of the first surface to a second position where a second portion of the surface area S of the second surface is disposed in facing relation with a corresponding surface area S of the first surface while the distance d between the first surface and the second surface remains substantially constant; and, wherein the second portion of the surface area S of the second surface is larger than the first portion of the surface area S of the second surface.

2. The mechanical vibration switch of claim 1, wherein the first surface of the magnet is curved.

3. The mechanical vibration switch of claim 1, wherein the first surface of the magnet is spherical.

4. The mechanical vibration switch of claim 1, wherein the electrical switch is a relay switch having a relay throw.

5. The mechanical vibration switch of claim 1, wherein the magnetic material part is cylindrical.

6. The mechanical vibration switch of claim 5, wherein the magnetic material part has a threaded portion.

7. The mechanical vibration switch of claim 1, wherein the relation between the magnetic force and the amount of surface area S of the first and second surfaces that is disposed in facing relation is substantially linear.

8. The mechanical vibration switch of claim 1, wherein the bar has a distal end and a proximal end.

9. The mechanical vibration switch of claim 1, wherein the magnet is disposed at the distal end of the bar.

10. The mechanical vibration switch of claim 1, wherein the bar is pivotally attached to a reference structure at the proximal end.

11. A mechanical vibration switch, comprising:

a bar pivotally attached to a reference structure;

one of a magnet and a magnetic material part disposed on the bar, the magnet having a first surface with a first surface area;

an inertial mass connected to the bar;

the other of the magnet and magnetic material part disposed in spaced apart relation to the one of a magnet and a magnetic material part such that a force acts on the bar in a first direction, the magnetic material part having a second surface, the second surface having a second surface area, the first and second surfaces facing each other when the bar engages with a stop;

an electrical switch coupled to the bar such that the state of the switch changes from open to closed depending on the position of the bar;

a spring acting on the bar to provide a force in a second direction opposite to the first direction;

wherein one of the magnet and magnetic material part is adjustable such that the amount of surface area S disposed in facing relation between the first surface and the second surface varies.

12. The mechanical vibration switch of claim 11, wherein the first surface of the magnet is curved.

13. The mechanical vibration switch of claim 11, wherein the first surface of the magnet is spherical.

14. The mechanical vibration switch of claim 11, wherein the electrical switch is a relay switch having a relay throw.

15. The mechanical vibration switch of claim 11, wherein the relation between the magnetic force and the amount of surface area S of the first and second surfaces that is disposed in facing relation is substantially linear.

16. The mechanical vibration switch of claim 11, wherein the bar has a distal end and a proximal end.

17. The mechanical vibration switch of claim 11, wherein one of the magnet and the magnetic material part is disposed at the distal end of the bar.

18. The mechanical vibration switch of claim 11, wherein the bar is pivotally attached to a reference structure at the proximal end.

19. A mechanical vibration switch, comprising:

a bar having a distal end and a proximal end, the bar pivotally attached to a reference structure at the proximal end;

an inertial mass attached to the bar;

a magnet disposed at the distal end of the bar, the magnet having a first surface with a first surface area;

a magnetic material part disposed in spaced apart relation to the magnet such that a magnetic force acts on the bar in a first direction, the magnetic material part having a second surface with a second surface area, the second surface facing the first surface on the magnet when the bar contacts a stop;

means for changing the state of a switch from open to closed in response to the position of the bar;

means for biasing the bar in a second direction opposite the first direction; and, means for advancing the magnetic material part such that the second surface moves parallel to the first surface of the magnet.

20. The mechanical vibration switch of claim 19, wherein the relation between the magnetic force and the amount of surface area S of the first and second surfaces that is disposed in facing relation is substantially linear.

* * * * *